US006861827B1

(12) United States Patent
Yang et al.

(10) Patent No.: US 6,861,827 B1
(45) Date of Patent: Mar. 1, 2005

(54) LOW DROP-OUT VOLTAGE REGULATOR AND AN ADAPTIVE FREQUENCY COMPENSATION

(75) Inventors: Ta-yung Yang, Milpitas, CA (US); Hsuan-I Pan, Taipei (TW); Chern-Lin Chen, Taipei (TW)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 10/666,803

(22) Filed: Sep. 17, 2003

(51) Int. Cl.[7] ..... G05F 1/40
(52) U.S. Cl. ..... 323/273; 323/280; 323/281
(58) Field of Search ..... 323/280, 273, 323/281, 274; 327/543

(56) References Cited

U.S. PATENT DOCUMENTS 5,686,821 A * 11/1997 Brokaw ..... 323/273
5,982,226 A * 11/1999 Rincon-Mora ..... 327/541
6,188,211 B1 * 2/2001 Rincon-Mora et al. ..... 323/280
6,246,221 B1 * 6/2001 Xi ..... 323/280
6,259,238 B1 * 7/2001 Hastings ..... 323/280
6,518,737 B1 * 2/2003 Stanescu et al. ..... 323/280
6,600,299 B2 * 7/2003 Xi ..... 323/280
6,677,735 B2 * 1/2004 Xi ..... 323/273
6,710,583 B2 * 3/2004 Stanescu et al. ..... 323/280
6,765,374 B1 * 7/2004 Yang et al. ..... 323/280
6,806,690 B2 * 10/2004 Xi ..... 323/273

* cited by examiner

*Primary Examiner*—Shawn Riley
(74) *Attorney, Agent, or Firm*—J.C. Patents

(57) ABSTRACT

A method and apparatus to dynamically modify the internal compensation of a low drop-out (LDO) voltage regulator is presented. The process involves creating an additional equivalent series resistance (ESR) from an internal circuit. The additional ESR of the internal circuit is sufficient to ensure the DC output stability. This allows the ESR of the output capacitance to be reduced to zero if desired, for improved transient response.

10 Claims, 8 Drawing Sheets

LOW DROP-OUT VOLTAGE REGULATOR AND AN ADAPTIVE FREQUENCY COMPENSATION

BACKGROUND OF THE INVENTION

1. Field of the Invention

The present invention relates to a voltage regulator circuit, and more particularly to a low drop-out voltage regulator and an adaptive frequency compensation method for the same.

2. Description of the Related Art

Voltage regulators with a low drop-out (LDO) are commonly used in the power management systems of PC motherboards, notebook computers, mobile phones, and many other products. Power management systems use LDO voltage regulators as local power supplies, where a clean output and a fast transient response are required. LDO voltage regulators enable power management systems to efficiently supply additional voltage levels that are smaller than the main supply voltage. For example, the 5V power systems of many PC motherboards use LDO voltage regulators to supply local chipsets with a clean 3.3V signal.

Although LDO voltage regulators do not convert power very efficiently, they are inexpensive, small, and generate very little frequency interference. Furthermore, LDO voltage regulators can provide a local circuit with a clean voltage that is unaffected by current fluctuations from other areas of the power system. LDO voltage regulators are widely used to supply power to local circuits when the power consumption of the local circuit is negligible with respect to the overall load of a power system.

An ideal LDO voltage regulator should provide a precise DC output, while responding quickly to load changes and input transients. Due to the nature of its use in mass-produced products such as computers and mobile phones, LDO voltage regulators should also have a simple design and a low production cost.

A typical LDO voltage regulator consists of a feedback-control loop coupled to a pass element. The feedback-control loop modulates the gate voltage of the pass element to control its impedance. Depending on the gate voltage, the pass element supplies different levels of current to an output section of the power supply. The modulation of the gate voltage is done in a manner such that the LDO voltage regulator outputs a steady DC voltage, regardless of load conditions and input transients.

One problem with traditional LDO circuits is that they are prone to instability. The output section of a traditional LDO circuit includes an output capacitor coupled to the load. This coupling introduces a dominant pole into the feedback circuit. Traditional LDO circuits rely on the equivalent series resistance (ESR) of the output capacitor to restore stability. Within a narrow range of values, the ESR can compensate for the output pole by introducing a zero into the LDO voltage regulator feedback-control loop. Within a range of operating conditions, the zero can increase the phase margin of the LDO voltage regulator.

Unfortunately, the ESR is a parasitic component of the output capacitor and its value cannot easily be determined or controlled to a high precision. The ESR of a capacitor changes significantly with respect to load, temperature, and possibly other factors. If the ESR increases or decreases too much, then the ESR zero will no longer compensate for the pole introduced by the output capacitor.

Another problem with traditional LDO voltage regulators is that the ESR adversely affects the transient response of the LDO voltage regulator. For a LDO voltage regulator to respond rapidly to transients, the ESR must be reduced as much as possible. However, a small ESR will shift the compensating zero of the ESR to a higher frequency, where it will no longer compensate for the pole induced by the output capacitor. In a traditional LDO voltage regulator, the ESR cannot be reduced without threatening the stability of the entire circuit.

Another problem with traditional LDO voltage regulators is that they have a slow transient response under light loads. Under light loads, the frequency of the output capacitor pole decreases. However, the frequency of the stabilizing zero does not change, and the cross-over frequency of the LDO voltage regulator is reduced. Traditional LDO voltage regulators are not designed to enable the stabilizing zero to follow the output pole. If the position of the zero could also be shifted to a lower frequency, the cross-over frequency of the LDO voltage regulator would not be reduced under light loads.

Traditional LDO voltage regulators are prone to instability since the ESR cannot be controlled precisely. Furthermore, their performance suffers degradation under light load conditions. Therefore, there is a need for an improved low drop-out voltage regulator that is suitable for a wider range of capacitive loads while eliminating the minimum ESR restriction of the output capacitor.

SUMMARY OF THE INVENTION

An objective of the present invention is to provide a low drop-out (LDO) voltage regulator that can provide DC—DC conversion with very tight output control for computer motherboards, notebook computers, mobile phones, and other products.

Another objective of the present invention is to provide an adaptive frequency compensation scheme for a LDO voltage regulator, such that the LDO voltage regulator is stable under a wide range of load conditions.

Another objective of the present invention is to provide a LDO voltage regulator with generally improved transient response.

Another objective of the present invention is to provide a LDO voltage regulator with a faster transient response under light-load conditions.

According to one aspect of the present invention, to improve stability, the adaptive frequency compensation scheme generates an equivalent series resistance (ESR). This introduces a zero into the feedback loop. The frequency of the generated zero can be controlled precisely. According to the present invention, it is possible to ensure circuit stability without controlling the lower limit of the equivalent series resistance (ESR) of the output capacitor. This is preferable, because the ESR of a capacitor can vary unpredictably with respect to temperature and load. Furthermore, the resistance of the current-controlled resistor can be varied in response to the output current, so that the frequency of the zero will follow the frequency of the output pole. This can help improve the transient response of the circuit.

According to another aspect of the present invention, for a DC output during transient-state operation, the output ESR should be low, and the cross-over frequency of the LDO voltage regulator should be high. The adaptive frequency compensation scheme of the present invention ensures the stability of the LDO voltage regulator with a generated ESR, rather than the ESR of the output capacitance. There is no need to control the lower limit of the ESR of the output capacitance. According to the present invention, the output section can contain an arbitrarily low capacitive ESR without endangering system stability. In practice, this enables the LDO voltage regulator to be optimized for improved transient performance.

Still further objects and advantages will become apparent from a consideration of the ensuing description and drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
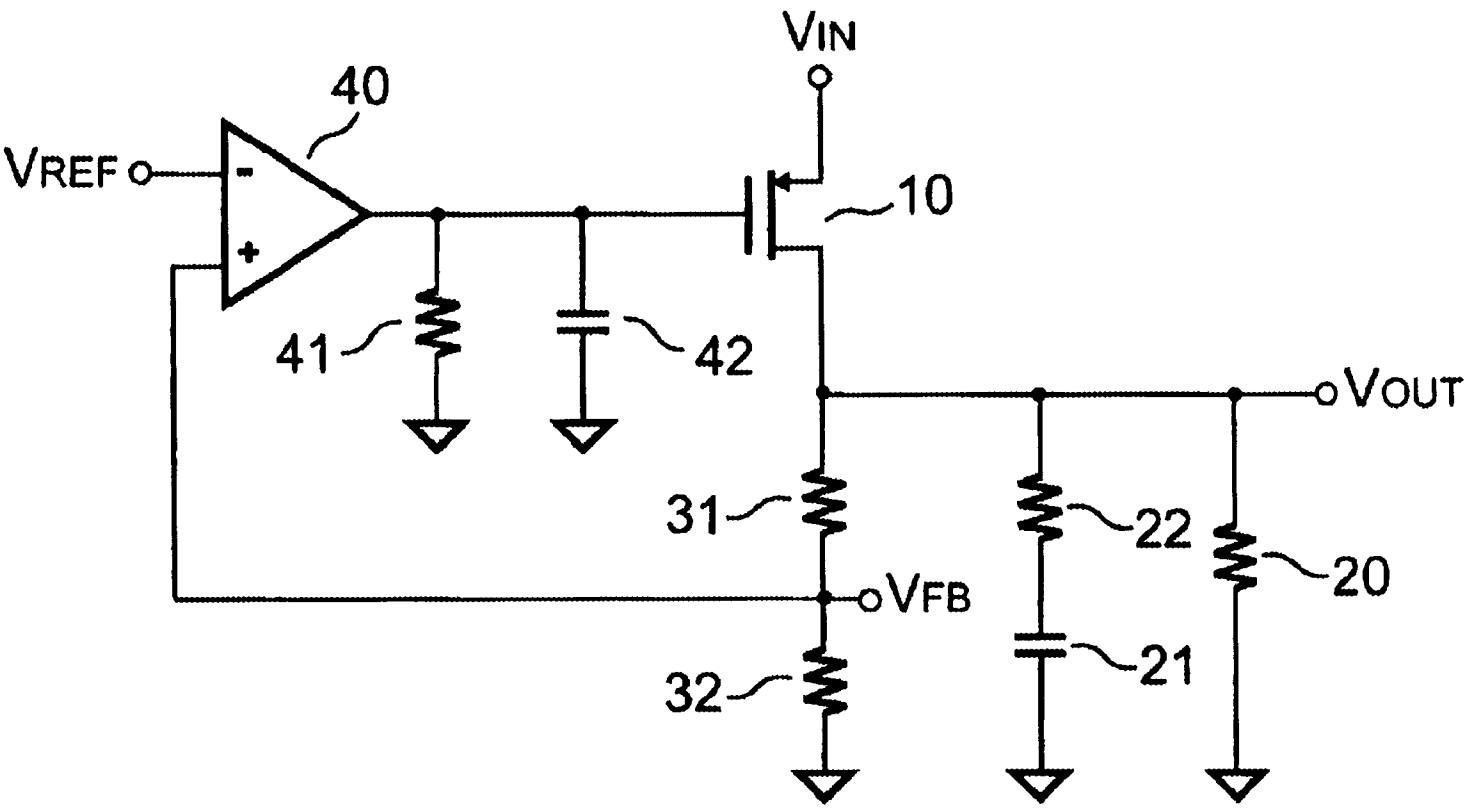
FIG. 1 (Prior Art)
FIG. 1 shows a prior-art LDO voltage regulator.

Referring now to the drawings wherein the contents are for purposes of illustrating the preferred embodiment of the invention only and not for purposes of limiting same, FIG. 1 shows a basic configuration of a prior-art low drop-out (LDO) voltage regulator.

The prior-art LDO voltage regulator includes an unregulated DC input port $V_{IN}$, an output pass transistor 10, a regulated DC output port $V_{OUT}$, and an output section comprising a load resistance 20, an output capacitor 21 and a parasitic equivalent series resistance (ESR) 22. The prior-art LDO voltage regulator further comprises a voltage divider having a voltage divider terminal $V_{FB}$, and two resistors 31 and 32. The prior-art LDO voltage regulator further comprises a feedback-control circuit. The feedback-control circuit comprises an error amplifier 40, a reference voltage port $V_{REF}$. The output impedance of the error amplifier 40 is represented as a resistor 41, which is connected from an output of the error amplifier 40 to the ground reference. A gate of the output pass transistor 10 has a parasitic capacitance represented as a capacitor 42, which is connected from the gate of the output pass transistor 10 to the ground reference.

The unregulated DC input port $V_{IN}$ is connected to a source of the output pass transistor 10. A drain of the output pass transistor 10 is connected to the regulated DC output port $V_{OUT}$. The load resistance 20 and the output capacitor 21 are connected in parallel between the regulated DC output port $V_{OUT}$ and the ground reference. The output capacitor 21 includes a parasitic ESR 22.

The regulated DC output port $V_{OUT}$ is connected to the feedback-control circuit via the voltage divider. The resistors 31 and 32 are connected in series between the regulated DC output port $V_{OUT}$ and the ground reference. The voltage divider terminal $V_{FB}$ is in between the resistors 31 and 32. The voltage divider terminal $V_{FB}$ is connected back to a positive input of the error amplifier 40. The reference voltage port $V_{REF}$ is connected to a negative input of the error amplifier 40. An output of the error amplifier 40 is connected to the gate of the output pass transistor 10. Operation of this circuit will be well known to those skilled in the art.

Figure 6:
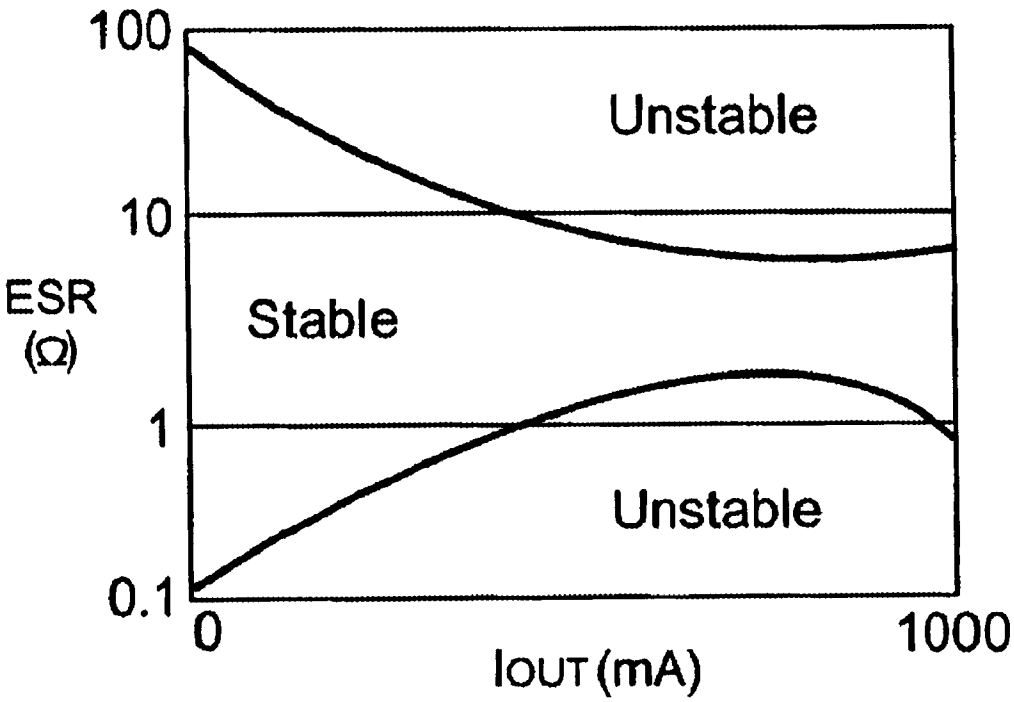
FIG. 6 (Prior Art)
FIG. 6 is a graph showing the approximate range of ESR values that guarantee the stability of the prior-art LDO voltage regulator.

As discussed, the prior-art circuit is prone to instability. If the slope at the cross-over frequency becomes less than −40 dB per decade, the system will be unstable. The stability of the circuit depends on the zero introduced by the parasitic ESR 22 of the output capacitor 21. However, the magnitude of the parasitic resistance can vary greatly with respect to small changes in the operating conditions of the circuit (load, temperature, etc). This can change the position of the zero, and cause the circuit to become unstable. FIG. 6 shows the range of values for the ESR that guarantee stability, for a typical prior-art LDO voltage regulator. It is important to notice that this range changes significantly with respect to the load current.

Figure 7A:
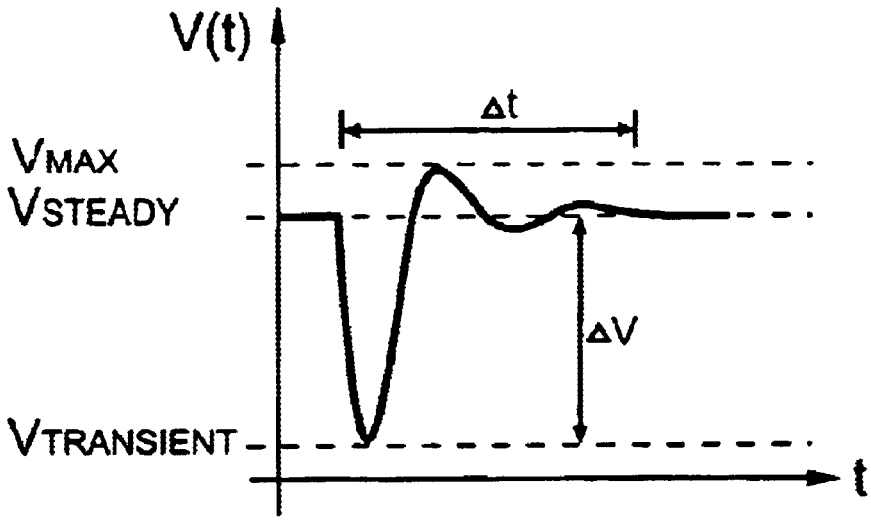
FIG. 7A (Prior Art)
FIG. 7A shows the transient response of the prior-art LDO voltage regulator.

Even if a stable ESR could be provided, it would adversely affect the transient performance of the circuit. FIG. 7A illustrates the effect of the ESR on the transient response of the prior-art LDO voltage regulator. During load changes, a high ESR will result in a less precise DC output. The higher the output ESR is, the deviation $\Delta V$ from the output voltage will be increased.

Figure 2:
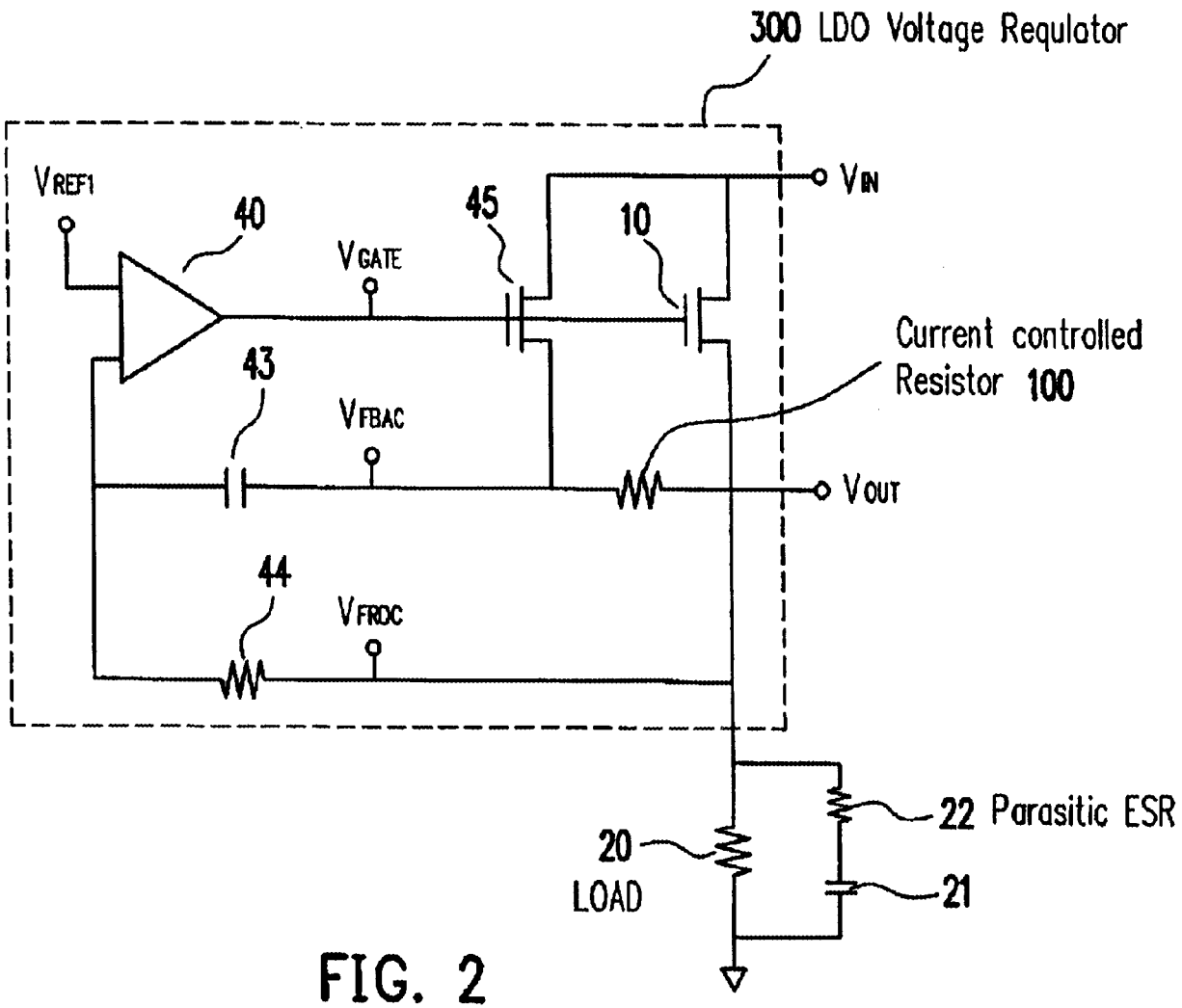
FIG. 2 shows a LDO voltage regulator according to the present invention.

FIG. 2 illustrates the basic scheme of a LDO voltage regulator circuit 300 according to the present invention. Details of the reference voltage supply circuit (which may be entirely conventional) have been omitted for simplicity. Like reference numerals are used where components correspond to those of the prior art arrangements described above. It will be seen that the illustrated circuit may be regarded as conventional in so far as it comprises an error amplifier 40 supplying a gate voltage to a gate signal terminal $V_{GATE}$. The gate signal terminal $V_{GATE}$ controls a gate of a P-MOSFET based output pass transistor 10. A reference voltage $V_{REF1}$ is supplied to a negative input of the error amplifier 40. When turned on, the output pass transistor 10 supplies power from an unregulated DC input port $V_{IN}$ to a regulated DC output port $V_{OUT}$. A load resistance 20 and an output capacitor 21 having a parasitic ESR 22 are connected in parallel from the regulated DC output port $V_{OUT}$ to the ground reference.

The feedback-control circuit of the present LDO voltage regulator is substantially different from that of prior-art LDO voltage regulators. To supply a feedback signal to the error amplifier 40, the feedback-control circuit according to the present invention includes an AC feedback terminal $V_{FBAC}$ and a DC feedback terminal $V_{FBDC}$. A source of a transistor 45 is connected to the unregulated DC input port $V_{IN}$. A gate of the transistor 45 is connected to the gate signal terminal $V_{GATE}$. A drain of the transistor 45 is connected to the AC feedback terminal $V_{FBAC}$. The AC feedback terminal $V_{FBAC}$ is connected to a positive input of the error amplifier 40 via a capacitor 43. The DC feedback terminal $V_{FBDC}$ is connected from the regulated DC output port $V_{OUT}$ to the positive input of the error amplifier 40 via a resistor 44. The DC feedback terminal $V_{FBDC}$ is equivalent to the regulated DC output port $V_{OUT}$.

The LDO voltage regulator according to the present invention further differs from prior-art LDO voltage regulators, in that in place of relying upon the parasitic ESR 22 to provide a zero, the circuit includes a current-controlled resistor 100. The current-controlled resistor 100 is connected between the regulated DC output port $V_{OUT}$ and the AC feedback terminal $V_{FBAC}$. This introduces a stabilizing zero into the transfer function that depends on the resistance of the current-controlled resistor 100, instead of depending on the parasitic ESR 22, as in prior-arts. Because the resistance of the current-controlled resistor 100 can be precisely controlled, it is no longer necessary to depend on the parasitic ESR 22 for the stability of the transfer function.

Figure 7B:
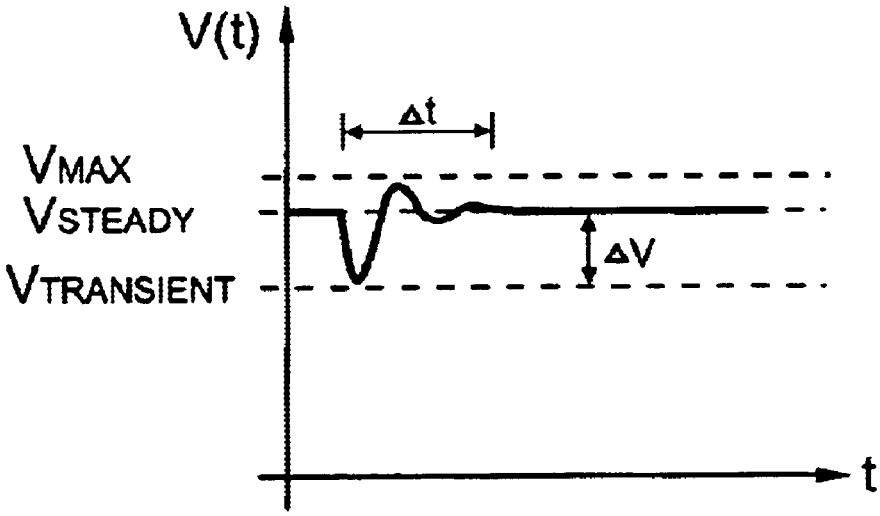
FIG. 7B shows the transient response of the LDO voltage regulator according to the present invention.

Prior-art LDO voltage regulators generally require a minimum value for the ESR of the output capacitor 21. This stabilizes the circuit, but it also adversely affects the transient response (FIG. 7A). During load changes, a high ESR will result in a larger deviation from the steady-state DC output voltage. In the LDO voltage regulator according to the present invention, the parasitic ESR 22 can be reduced arbitrarily without endangering system stability. Because of this, it is possible to improve the transient response of the LDO voltage regulator by using a capacitor with a very low ESR for the output capacitor 21. This allows the LDO voltage regulator to be optimized for improved transient response, so that the deviation $\Delta V$ from the output voltage will be reduced (FIG. 7B).

The feedback-control circuit of the present invention takes a high-frequency feedback signal from the AC feedback terminal $V_{FBAC}$. The capacitor 43 is necessary as a DC blocking device, because the AC feedback terminal $V_{FBAC}$ cannot be used to control the magnitude of the output voltage $V_{OUT}$. This is because a small current will flow across the current-controlled resistor 100. This current will change with respect to the magnitude of the output load. As this current changes with respect to output load, the potential drop across the current-controlled resistor 100 will also change.

Therefore, it is necessary to include a DC feedback terminal $V_{FBDC}$ to supply the DC component of the feedback signal to the error amplifier 40. The DC feedback voltage is supplied to the positive input of the error amplifier 40 via the resistor 44. If the resistance of the resistor 44 is sufficiently large, it will prevent the high-frequency behavior of the LDO voltage regulator from being affected. A typical value for the resistance of the resistor 44 would be about 10 MΩ.

Figure 8A:
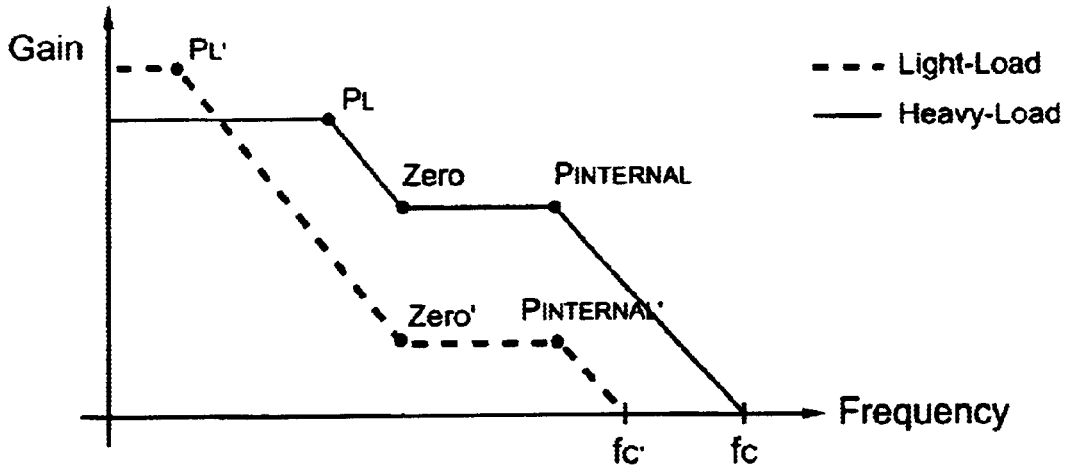
FIG. 8A (Prior Art)
FIG. 8A compares the pole-zero locations and cross-over frequencies of the transfer function of the prior-art LDO voltage regulator. The solid line indicates the transfer function under a heavy-load and the dotted line indicates the transfer function under a light-load.

The transient response of the prior-art LDO voltage regulator deteriorates under light loads. This happens because the frequency of the dominant pole decreases. However, the frequency of the stabilizing zero introduced by the parasitic ESR 22 does not change. This reduces the cross-over frequency, and with that, the transient response of the circuit. FIG. 8A demonstrates this effect, where the solid-line shows the frequency response under heavy-loads, and the dotted-line indicates the frequency response under light-loads. Because the cross-over frequency decreases from $f_c$ to $f_c'$ under light-loads, the transient response of the LDO voltage regulator slows down. When load changes occur, the output of the LDO voltage regulator takes more time $\Delta t$ to adjust (FIG. 7A).

Figure 8B:
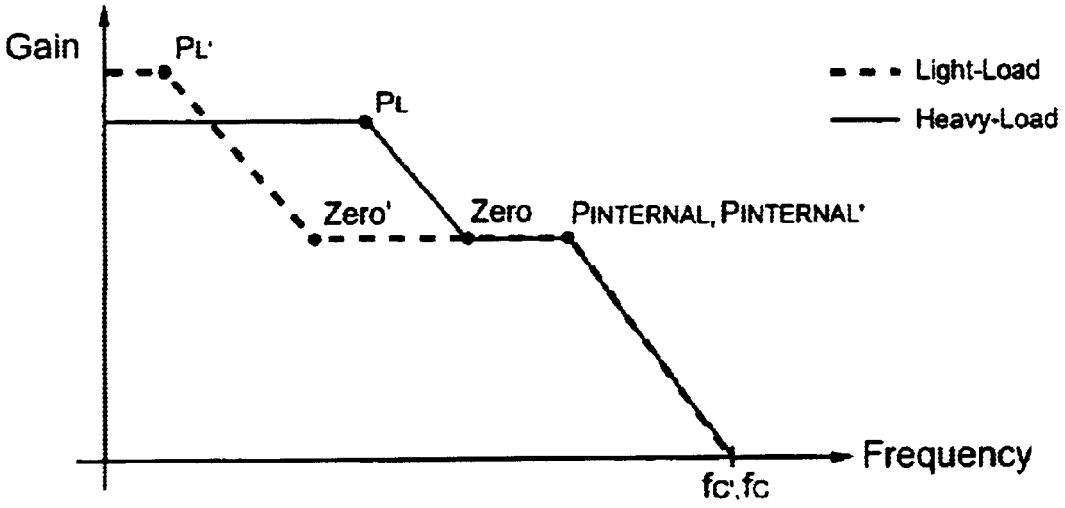
FIG. 8B compares the pole-zero locations and cross-over frequencies of the transfer function of the LDO voltage regulator according to the present invention. The solid line indicates the transfer function under a heavy-load and the dotted line indicates the transfer function under a light-load.

To avoid degradation to the transient response under light-load conditions, the resistance of the current-controlled resistor 100 changes with respect to the load. This changes the Bode-plot while maintaining DC stability. FIG. 8B demonstrates the effect of the current-controlled resistor 100, where the solid-line shows the frequency response under heavy-loads, and the dotted-line indicates the frequency response under light-loads. Because the cross-over frequency ($f_c$, $f_c'$) does not change under light-load conditions, the transient response of the LDO voltage regulator does not suffer degradation. FIG. 7B shows that the time $\Delta t$ required for stabilizing the output voltage of the LDO voltage regulator is substantially shorter than that in the prior-art.

Figure 3:
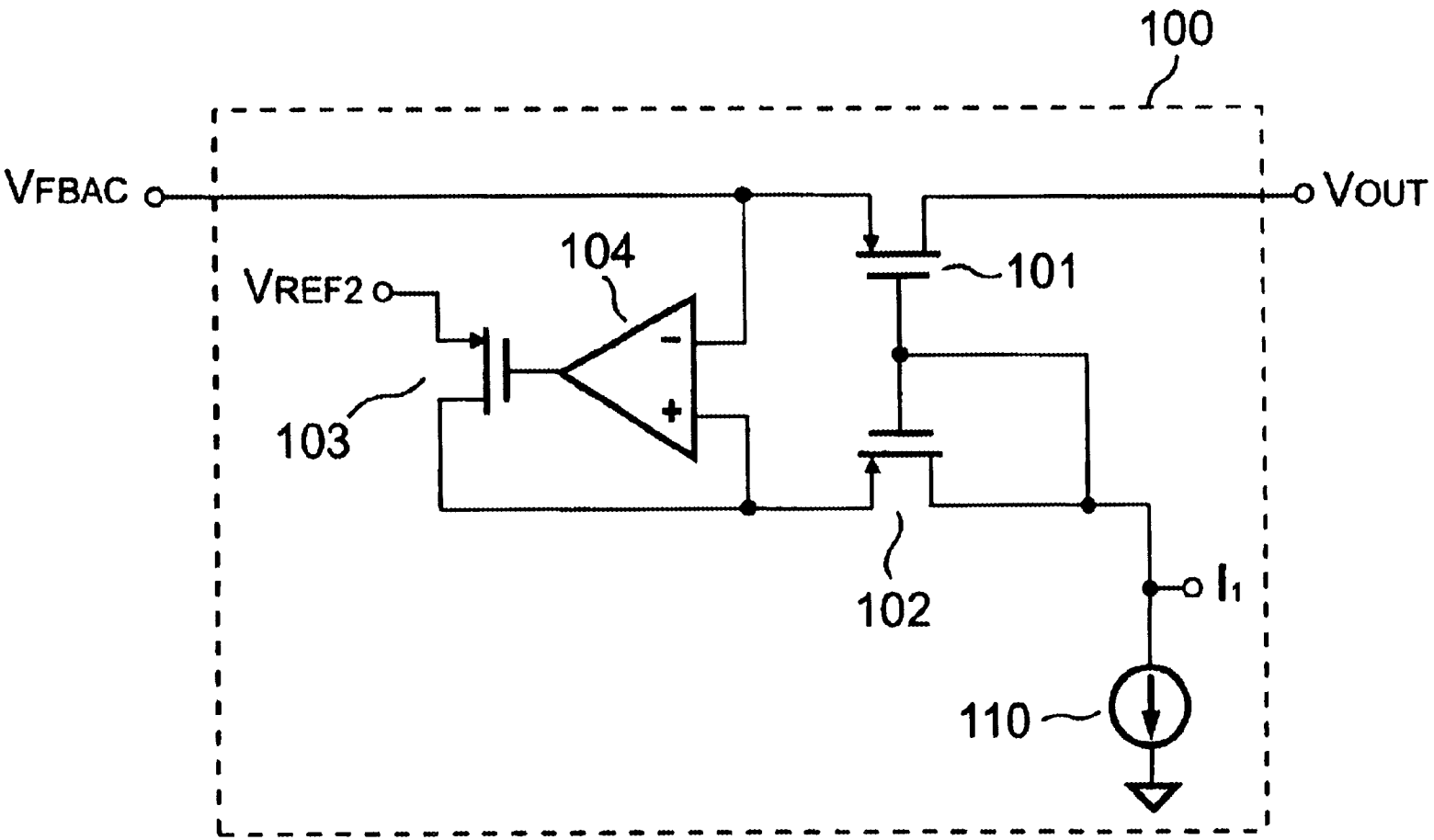
FIG. 3 shows an embodiment of a current-controlled resistor according to the present invention.

FIG. 3 shows the current-controlled resistor 100 according to a preferred embodiment of the present invention. The current-controlled resistor 100 consists of three transistors 101, 102 and 103, a comparator 104, and a current-controlled current sink 110. A drain of the transistor 101 is connected to the regulated DC output port $V_{OUT}$. A gate of the transistor 101 is connected to a gate of the transistor 102 and a drain of the transistor 102. A source of the transistor 101 is connected to the AC feedback terminal $V_{FBAC}$. A drain of the transistor 102 is connected to an input current terminal $I_1$. A source of the transistor 102 is connected to a drain of the transistor 103. A source of the transistor 103 is connected to a reference voltage terminal $V_{REF2}$. A gate of the transistor 103 is connected to an output of the comparator 104. A negative input of the comparator 104 is connected to the AC feedback terminal $V_{FBAC}$. A positive input of the comparator 104 is connected to the drain of the transistor 103. An input of the current-controlled current sink 110 is connected to the input current terminal $I_1$. An output of the current-controlled current sink 110 is connected to the ground reference.

The resistance of the current-controlled resistor 100 changes in response to the output current. Therefore, the frequency of the zero generated by the current-controlled resistor 100 can change with respect to the output load. This allows the transient response of the LDO voltage regulator to be optimized under heavy-load and light-load conditions. The operation of this circuit is well known to those skilled in the art, and does not need to be discussed in further detail here.

Figure 4:
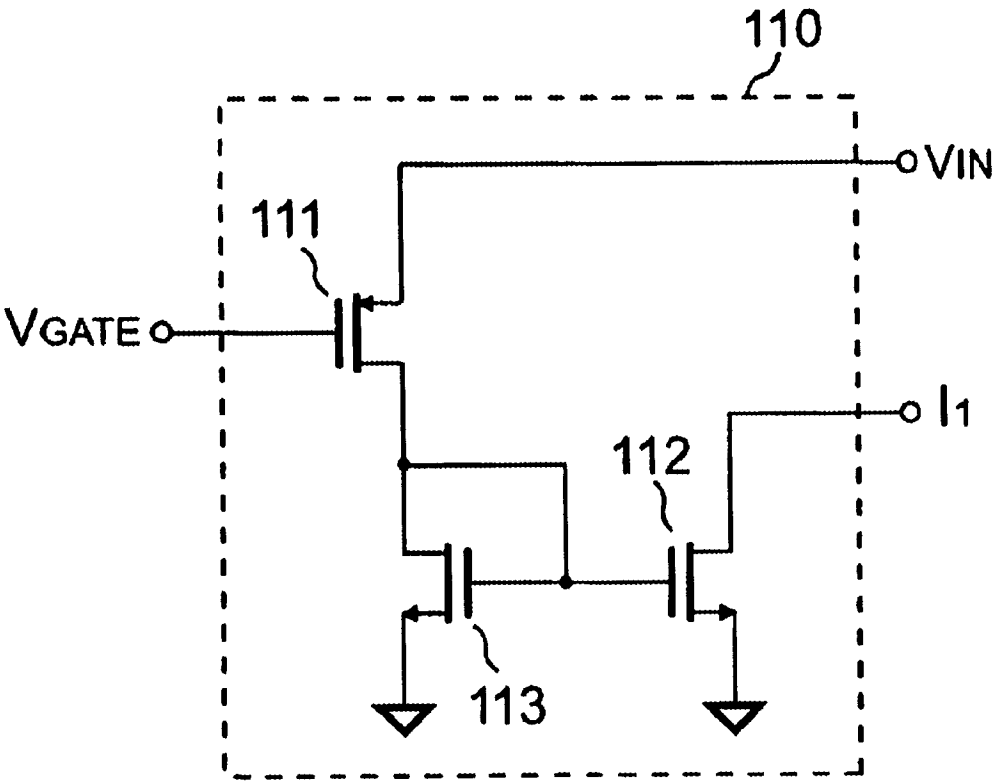
FIG. 4 shows an embodiment of a current-controlled current sink according to the present invention.

FIG. 4 shows the current-controlled current sink 110 according to an preferred embodiment of the present invention. The current-controlled current sink 110 consists of three transistors 111 112 and 113. A gate of the transistor 111 is connected to the gate signal terminal $V_{GATE}$. A source of the transistor 111 is connected to the unregulated DC input port $V_{IN}$. A drain of the transistor 111 is connected to a drain of the transistor 113, a gate of the transistor 113, and a gate of the transistor 112. A source of the transistor 113 and a source of the transistor 112 are connected to the ground reference. A drain of the transistor 112 is connected to the input current terminal $I_1$. The operation of this circuit is well known to those skilled in the art, and does not need to be discussed in further detail here.

Referring to FIG. 2, the gate signal terminal $V_{GATE}$ drives the gate of the transistor 45. Therefore, the current flowing from the source to the drain of the transistor 45 will be proportional to the current flowing from the source to the drain of the output pass transistor 10. The physical dimensions of the output pass element 10 and the transistor 45 determine a proportion N, where the current flowing through the output pass transistor 10 will be N times the current flowing through the transistor 45. In the LDO voltage regulator according to the present invention, the proportion N is chosen such that the feedback current will not consume any more power than necessary in order to obtain an accurate high-frequency feedback signal. In many practical applications, typical values for N would be 500–1000.

The resistor 44 shown in FIG. 2 is required to have a large resistance (10 M Ω or more). In practice, however, it is very difficult to make a resistor with a large resistance in integrated circuits.

Figure 5:
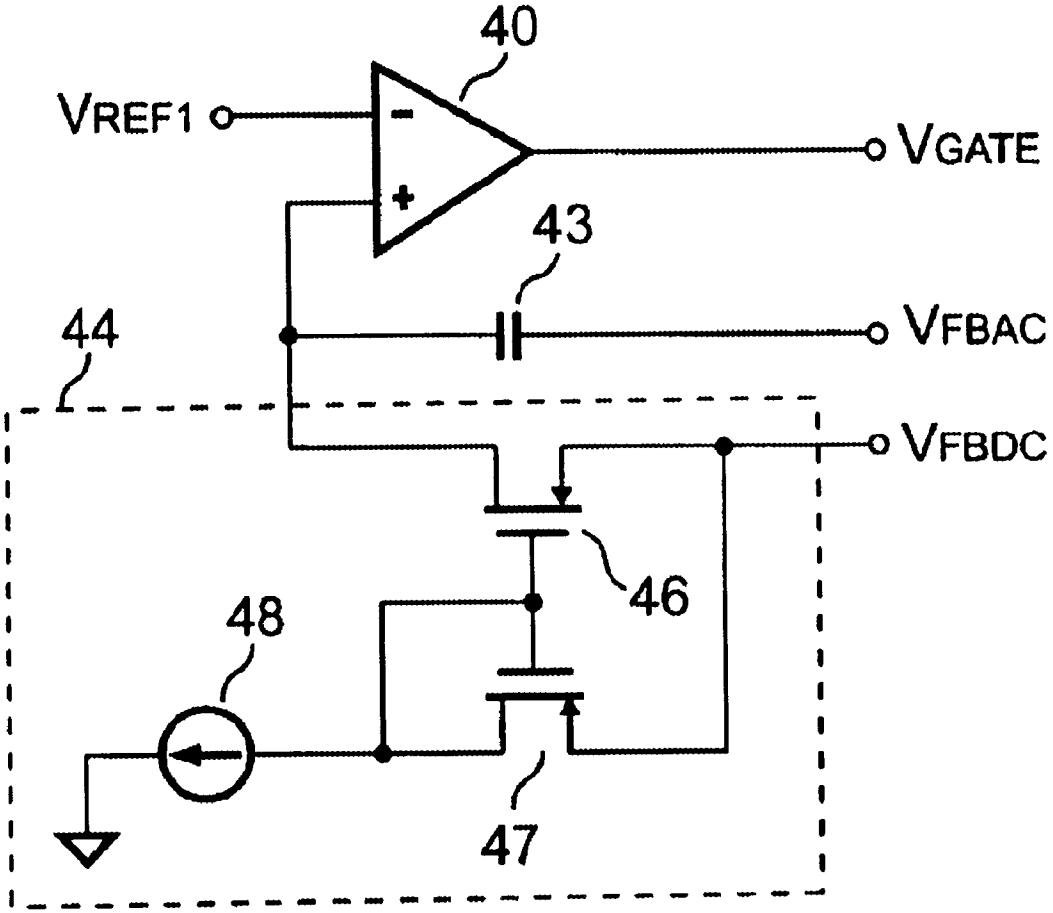
FIG. 5 shows an embodiment of building a large resistance of the present invention.

FIG. 5 demonstrates in detail how to build the resistor 44 with a large resistance. The resistor 44 includes a current sink 48 and two transistors 46 and 47. A source of the transistor 46 is connected to the DC feedback terminal $V_{FBDC}$. A drain of the transistor 46 is connected to the positive input of the error amplifier 40. A gate of the transistor 46 is connected to a gate of the transistor 47, a drain of the transistor 47 and an input of the current sink 48. A source of the transistor 47 is connected to the DC feedback terminal $V_{FBAC}$. An output of the current sink 48 is connected to the ground reference. The current sink 48 biases the transistor 46 to operate in linear mode, so that it acts as a resistor. The operation of current mirrors is well known to those skilled in the art, and does not need to be discussed in further detail here.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims or their equivalents.

What is claimed is:

1. A low drop-out voltage regulator having an adaptive frequency compensation means, comprising:

a regulated DC output terminal;

an unregulated DC input terminal;

an output section having an output capacitor and an output load, wherein said output load is connected from said regulated DC output terminal to the ground reference, wherein said output capacitor is connected in parallel with said output load;

an output pass transistor for supplying power to said output section, wherein said output pass transistor has a source coupled to said unregulated DC input terminal, wherein said output pass transistor has a drain connected to said regulated DC output terminal;

a control circuit for controlling a gate of said output pass transistor; and a current-controlled resistor for generating a zero-pole, wherein said current-controlled resistor generates an additional equivalent series resistance (ESR).

2. The low drop-out voltage regulator according to claim 1, wherein said control circuit comprises:

an error amplifier for generating a common gate signal, wherein said error amplifier has a negative input connected to a first reference voltage terminal;

an AC feedback terminal for supplying a high-frequency feedback signal to said error amplifier;

a blocking capacitor for blocking DC components from said AC feedback terminal, wherein said blocking capacitor is connected between a positive input of said error amplifier and said AC feedback terminal;

a feedback transistor for supplying a feedback current to said AC feedback terminal, wherein said feedback current is proportional to an output current of the output section, wherein said feedback transistor has a source coupled to said unregulated DC input terminal, wherein said feedback transistor has a drain coupled to said AC feedback terminal;

a DC feedback terminal for supplying a steady-state feedback signal to said error amplifier, wherein said DC feedback terminal is connected to said regulated DC output terminal; and a large-resistance resistor for maintaining the DC accuracy of the feedback signal, wherein said large-resistance resistor is connected between said DC feedback terminal and said positive input of said error amplifier, wherein said large-resistance resistor is a device with an equivalent resistance of 10 M Ω or more.

3. The low drop-out voltage regulator according to claim 1, wherein said current-controlled resistor is connected between said regulated DC output terminal and said AC feedback terminal, wherein said current-controlled resistor comprises:

an input current terminal;

a first pole-zero transistor having a drain connected to said regulated DC output terminal, wherein said first pole-zero transistor has a source connected to said AC feedback terminal;

a second pole-zero transistor having a drain connected to said input current terminal, wherein said second pole-zero transistor has a gate connected to a gate of said first pole-zero transistor and said drain of said second pole-zero transistor;

a third pole-zero transistor having a drain connected to a source of said second pole-zero transistor, wherein said third pole-zero transistor has a source connected to a second reference voltage terminal;

a pole-zero comparator having an output connected to a gate of said third pole-zero transistor, wherein said pole-zero comparator has a negative input connected to said AC feedback terminal, wherein said pole-zero comparator has a positive input connected to said drain of said third pole-zero transistor; and a current-controlled current sink having an input connected to said input current terminal, wherein said current-controlled current sink has an output connected to the ground reference.

4. The low drop-out voltage regulator according to claim 3, wherein said current-controlled current sink comprises:

a first current-sink transistor having a gate connected to a common gate signal terminal, wherein said first current-sink transistor has a source connected to said unregulated DC input terminal;

a second current-sink transistor having a drain connected to a drain of said first current-sink transistor, wherein said second current-sink has a source connected to the ground reference; and a third current-sink transistor having a gate connected to a gate of said second current-sink transistor and said drain of said second current-sink transistor, wherein said third current-sink transistor has a drain connected to said input current terminal, wherein said third current-sink transistor has a source connected to the ground reference.

5. The low drop-out voltage regulator according to claim 1, wherein said common gate signal is provided by an output of said error amplifier to said gate of said output pass transistor and a gate of said feedback transistor.

6. The low drop-out voltage regulator according to claim 1, wherein said feedback transistor and said output pass transistor are arranged such that the current from said source of said output pass transistor is at least 500 times greater than the current from said source of said feedback transistor.

7. The low drop-out voltage regulator according to claim 2, wherein said large-resistance resistor comprises:

a current sink for biasing said large-resistance resistor, wherein said current sink has an output connected to the ground reference; and a current mirror having a first lr-transistor and a second lr-transistor, wherein said current mirror is coupled to an input of said current sink, wherein a source of said first lr-transistor and a source of said second lr-transistor are connected to said DC feedback terminal, wherein a drain of said first lr-transistor is connected to said positive input of said error amplifier.

8. The low drop-out voltage regulator according to claim 1, wherein said low drop-out voltage regulator is stable for any parasitic ESR of said output section less than 50 mΩ.

9. A method of circuit operation in a low drop-out voltage regulator comprising:

accepting a reference voltage at an error amplifier, wherein an output of said error amplifier supplies a common gate signal;

controlling a first transistor by means of said common gate signal to produce an output signal at an output terminal of the voltage regulator from an unregulated input voltage;

controlling a second transistor by means of said common gate signal to supply a high-frequency feedback signal from said unregulated input voltage to an input of said error amplifier;

introducing a zero into the transfer function of the voltage regulator by means of a current-controlled resistor, such that the circuit will be stable when the ESR of an output capacitor of the voltage regulator is lower than 50 mΩ;

supplying said output signal of the power supply to an input of said error amplifier via a large-resistance resistor, wherein the resistance of said large-resistance resistor is at least 10 MΩ; and modulating said common gate signal based on the sum of said high-frequency feedback signal and said output signal supplied to said error amplifier.

10. The method of circuit operation in a low drop-out voltage regulator according to claim 9, wherein for a given gate voltage, the output current of said first transistor is at least 500 times greater than the output current of said second transistor.

* * * * *